United States Patent [19]

Pasch

[11] 4,252,305

[45] Feb. 24, 1981

[54] VISE JAW COVER

[76] Inventor: Rynold W. Pasch, Rte. #1, Box 106, Gilbert, Minn. 55741

[21] Appl. No.: 143,186

[22] Filed: Apr. 24, 1980

[51] Int. Cl.[3] ..... B25B 1/24

[52] U.S. Cl. ..... 269/274

[58] Field of Search ..... 269/257, 264, 271, 274–275, 269/277, 285, 321 R; 81/180 R, 180 B, 186

[56] References Cited

U.S. PATENT DOCUMENTS

| | | | |
|---|---|---|---|
| 2,766,649 | 10/1956 | Labry, Jr. | 269/274 |
| 2,778,257 | 1/1957 | Linskey et al. | 269/274 |

*Primary Examiner*—Robert C. Watson

*Attorney, Agent, or Firm*—Schroeder, Siegfried, Ryan, Vidas, Steffey & Arrett

[57] ABSTRACT

Vise jaw covers, each of which comprises a flexible, elongated panel made of soft, resilient, compressible material such as latex rubber, and having a relatively wide end portion severed along a U-shaped line to define an opening with an adjacent flap and having an intermediate portion and a relatively narrow end portion which is brought up and over the face of the vise jaw after the latter is forced through the opening and then outwardly and downwardly along the back of the neck of the vise jaw, through the opening and tensioned, whereupon the opening-defining portions clamp the panel in snug-fitting enveloping relation to the vise jaw with the soft intermediate portion stretched across the work-engaging surface of the vise jaw.

16 Claims, 2 Drawing Figures

VISE JAW COVER

DESCRIPTION

Brief Summary of the Invention

This invention relates to vises. More particularly, it relates to covers for vise jaws to enable the operator to more safely, effectively and efficiently mount and hold fragile or easily marred pieces of work.

It is a general object of my invention to provide novel and improved covers for vise jaws which are of simple and inexpensive construction.

A more specific object is to provide novel and improved covers for vise jaws of simple and inexpensive manufacture, application, utilization and having increased efficiency.

Another object is to provide novel and improved covers which will more effectively and more safely hold pieces of work which are either fragile or easily marred.

BRIEF DESCRIPTION OF THE DRAWINGS

A detailed description of one preferred embodiment of a vise jaw cover is hereafter described with specific reference being made to the drawings, in which.

DETAILED DESCRIPTION OF THE INVENTION

Figure 1:
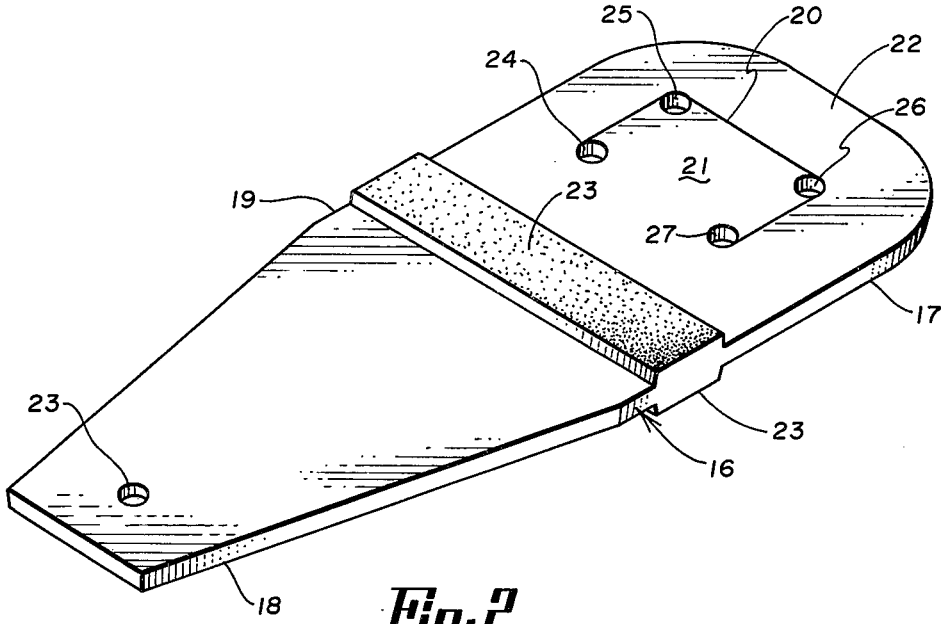
FIG. 1 is a perspective view of one of the panels comprising the invention.
Figure 2:
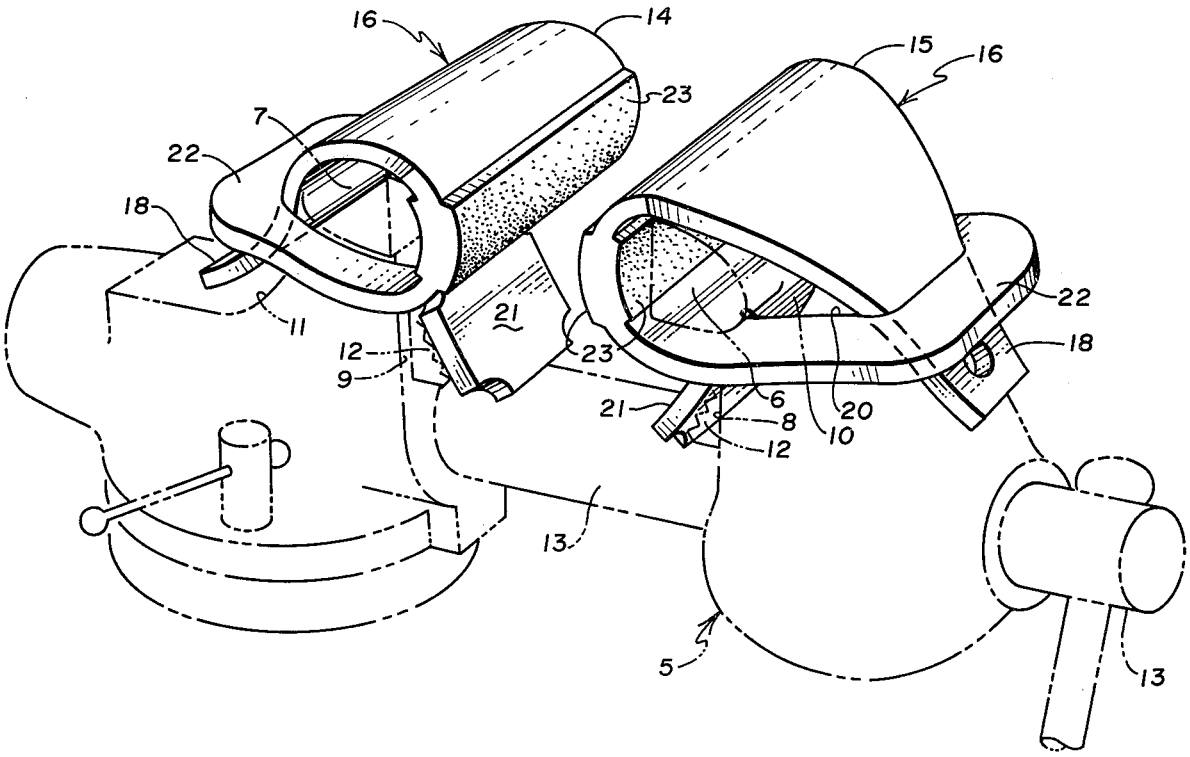
FIG. 2 is a pictorial view of a vise with a pair of vise jaw covers comprising the invention applied to the opposed work-engaging jaws thereof.

The preferred embodiment of my invention is shown in FIG. 1 and a pair of embodiments is shown in FIG. 2 properly applied to the vise jaws of a vise identified by the numeral 5. As shown, the vise 5 has a pair of opposed vise jaws 6 and 7. As is conventional in vises, the jaw 6 is supported by a restricted neck portion 8 having a sloping backside 10 immediately adjacent the vise jaw and extending outwardly and downwardly therefrom. As shown in FIG. 2, the vise jaw 6 has an associated pipe-engaging surface 12 which is serrated longitudinally thereof and with respect to the vise jaw 6. Such a serrated surface is utilized to engage pipes and other cylindrical items, such as shafts, which normally are extremely difficult to hold in flat vise jaws, such as shown on the jaws 6 and 7. It will be noted that the pipe-engaging surface 12 is located below the vise jaw 6 and at the interior of the vise so that the pipe or other cylindrical object may rest in the channel provided by the surface 12 and the vise jaw 6.

The opposing vise jaw 7 has a similar restricted neck 9 which has an outwardly and downwardly sloping backside 11. It is also provided with a serrated pipe-engaging surface similar to and opposing the serrated pipe-engaging surface 12 of the jaw 6. The jaws 6 and 7 are capable of being moved toward and away from each other by rotation of the shaft 13 in the conventional manner, as will be readily understood.

Each of the vise jaw covers 14 and 15 shown in FIG. 2 is comprised of a flexible, elongated panel indicated generally by the numeral 16, as shown in FIG. 1., which is made of soft, resilient, compressible material, such as latex rubber and has a relatively wide end portion 17, a relatively narrow end portion 18, and an intermediate portion 19. As shown in FIG. 1, panel 16 tapers from its wide end 17 to its narrow end 18. The panel 16 is severed along a U-shaped line identified by the numeral 20 and facing toward the narrow end 18. By cutting the wide end portion 17 along the line 20, a flap member 12 is formed. As shown, it is anchored to the intermediate portion 19 at one side thereof and is utilized, as will be hereinafter described. The opening created by the cut along the line 20 is defined along one of its sides by the extreme wide end portions 22. Disposed directly opposite the flap 21 and the opening defined by the cut along line 20 is a roughly textured rectangular area 23. This area 23 is located so that it will be arranged, as shown in FIG. 2, directly over the work-engaging surface of the vise jaw when it is applied in a manner to be hereinafter described. Preferably, a textured area 23 is carried at each of the sides of the panel 16 so as to obviate any need for turning the panel over when it is desired to apply same to a vise jaw.

The transverse dimensions of the openings defined by the cut along the line 20 are somewhat less than the length of the jaws 6 and 7 and the longitudinal length of the cut 20 approximates the transverse dimensions of such jaws. As a consequence, if the flap 21 is bent downwardly, one of the jaws 6, 7 can be inserted from below through the opening defined by the cut 20 and the flap 21 will thereby extend along and across the serrated working surface 12 of the jaw. The intermediate and narrow end portions of the panel 16 are then swung upwardly and outwardly so that the textured surface 23 will be disposed directly opposite the work-engaging surface of the jaw and the narrow end portion will extend outwardly and downwardly along the backside of the neck of the jaw. When the narrow end portion is inserted into the opening defined by the cut 20, and tensioned, the extreme wide end portions of the panel will pinch the narrow end portion thereof tightly against the backside of the jaw and hold the panel in snug jaw-enveloping relation, as shown in FIG. 2. When such a panel 16 is so applied to each of the jaws 6, 7 a pair of textured, soft and readily compressible surfaces will cover the work-engaging surfaces of the jaws and enable the operator to firmly and securely hold either a fragile object, such as a light bulb, or a highly polished and easily marred surface, such as a chrome or highly polished steel, silver or other surface which can be easily marred. When so held between a pair of jaws with a pair of such covers, the operator can readily work upon such items without fear of marring or breaking the item upon which he is working.

In the event the item is a cylindrical item, such as a highly polished piece of pipe (for example, a motorcycle exhaust pipe), such an item can be readily secured by placing the same upon the flaps 21 and tightening the vise whereupon the cylindrical item will be firmly gripped between the flap 21 and the surfaces 23, which are carried by the vise jaws 6 and 7.

The opening 23, which is formed through the narrow end portion 18, is merely to facilitate storing the panel by hanging the same upon a nail. The other openings 24, 25, 26 and 27 are circular in shape and are so formed in order to minimize the likelihood of the soft latex rubber tearing at the corners and ends of the cut 20.

From the above, it can readily be seen that I have provided a novel and improved vise jaw cover which can be readily, easily and quickly applied and which will function in a superior manner to hold any fragile or highly polished piece of work while work is performed thereon. By merely tensioning the narrow end portion 18, each of the covers will automtically and positively secure itself in snug-fitting and non-slipping relation to the jaw to which it is applied and, as a consequence, the operator can work more effectively because the piece of work will be firmly and securely held in the desired position without danger of marring or breaking the same.

In considering this invention, it should be remembered that the present disclosure is illustrative only and the scope of the invention should be determined by the appended claims.

I claim:

1. Work holding apparatus comprising:

(a) a vise having a pair of opposed vise jaws having opposed work-engaging surfaces controllably movable toward and away from each other;

(b) each of said vise jaws being elongated and having a relatively restricted neck portion supporting the same;

(c) each of said necks having a back side;

(d) each of said vise jaws having a serrated interior gripping surface disposed below its said work-engaging surface and moving therewith; and (e) a pair of vise jaw covers, one each of which envelopes one of said vise jaws;

(f) each of said covers being comprised of a flexible elongated panel made of an elastic, compressible and resilient material;

(g) each of said panels having a relatively narrow end portion, an opposite relatively wide end portion, and an intermediate portion;

(h) said relatively wide end portion of each of said panels having an opening formed therein defined in part by the extreme end portion of said relatively wide end portion;

(i) the opening of each of said panels being located adjacent its said intermediate portion;

(j) the neck portion of the vise jaw enveloped by each of said vise jaw covers extending upwardly through its associated vise jaw cover opening;

(k) the intermediate portion of each of said panels extending upwardly across the work-engaging surface of its associated vise jaw;

(l) said relatively narrow end portion of each of said panels extending downwardly and outwardly along the back side of the neck of its associated vise jaw and downwardly through said panel opening between said back side of said neck and said extreme end portion of said wide end portion;

(m) said narrow end portion of said intermediate portion of each of said panels being tensioned longitudinally of its panel to thereby cause said extreme end portion of the associated wide end portion to pinch and positively secure said relatively narrow end portion of the panel against its associated neck back side to thereby hold said intermediate portion in fixed position across the work-engaging surface of its said associated vise jaw.

2. The structure defined in claim 1 wherein a portion of each of said panels is comprised of a flap defined by said panel opening and extending downwardly over the serrated interior gripping surface of its associated vise jaw.

3. The structure defined in claim 1 wherein the central area of said relatively wide end portion of each of said panels is severed along a U-shaped line facing, when said panel is in its free state, toward its said relatively narrow end portion and thereby defining a flap anchored to said intermediate portion and extending downwardly over the said serrated interior gripping surface of its associated vise jaw.

4. The structure defined in claim 1 wherein said intermediate portion of each of said panels has a textured work-engaging surface disposed opposite the work-engaging surface of its associated vise jaw and facing away therefrom toward the opposite vise jaw and cover.

5. A vise jaw cover comprising:

(a) a flexible elongated panel made of an elastic, compressible and resilient material;

(b) said panel having a relatively narrow end portion, an opposite relatively wide end portion, and an intermediate portion;

(c) said relatively wide end portion having an opening formed therein defined on at least one of its sides by the extreme end portions of said wide end portion;

(d) said opening being located adjacent said intermediate portion and having dimensions sufficient to permit a vise jaw to be passed upwardly therethrough, said panel being constructed and arranged to permit said intermediate portion to extend upwardly across the face of that vise jaw when the latter so extends through said opening and said relatively narrow end portion to extend across the top of the vise jaw and downwardly through said opening between the back of the vise jaw and said extreme end portions to thereby cause the latter to compress said relatively narrow end portion against the back side of the vise jaw when tension is applied to said narrow end portion and thereby secure said panel in snug vise-jaw enveloping position.

6. The structure defined in claim 5 wherein the transverse dimensions of said opening approximate the width of said relatively narrow end portion.

7. The structure defined in claim 5 wherein said opening is defined in part by said intermediate portion.

8. The structure defined in claim 5 wherein a portion of said panel is comprised of a flamp defined by said opening and extendable downwardly over the serrated interior work-engaging surface of the vise jaw when the vise jaw is so received within said opening.

9. The structure defined in claim 5 wherein the central area of said relatively wide end portion is severed along a U-shaped line facing toward said relatively narrow end portion, thereby defining a flap anchored to said intermediate portion and swingable downwardly over the serrated interior work-engaging surface of the vise jaw when the vise jaw is so received within said opening.

10. The structure defined in claim 5 wherein said panel is approximately one-eighth ($\frac{1}{8}$") inch to one (1") inch thick.

11. The structure defined in claim 5 wherein said panel is made of latex rubber.

12. The structure defined in claim 5 wherein the transverse dimensions of said opening are greater than its longitudinal dimensions.

13. The structure defined in claim 5 wherein the transverse dimensions of said opening are less than the length of the vise jaw to which it is applied.

14. The structure defined in claim 5 wherein the transverse dimensions of said opening are less than the transverse dimensions of said intermediate portions of said panel.

15. The structure defined in claim 5 wherein said intermediate portion of said panel has a textured work-engaging surface at one of its sides adjacent said opening.

16. A vise jaw covering comprising:

(a) an elongated panel of flexible resilient material tapered in its transverse dimension toward one of its end portions;

(b) said panel having an opening formed in its wider end portion of dimensions sufficient to permit a vise jaw to be passed therethrough;

(c) said panel opening having transverse dimensions approximating the width of the smaller end portion of said panel and having its dimensions extending longitudinally of said panel only slightly greater than the transverse dimensions of a vise jaw whereby such a vise jaw may be inserted through said opening and the narrower of said end portions of said panel may be brought upwardly across the vise jaw face and along the back of said vise jaw and through said opening between the back of the vise jaw and the material of said wider end portion defining said opening to thereby cause said opening-defining portions to positively engage said narrower end portion in clamping relation to secure said panel in snug vise-jaw enveloping position.

* * * * *

UNITED STATES PATENT AND TRADEMARK OFFICE

CERTIFICATE OF CORRECTION

PATENT NO. : 4,252,305

DATED : February 24, 1981

INVENTOR(S) : Rynold W. Pasch

It is certified that error appears in the above-identified patent and that said Letters Patent are hereby corrected as shown below:

Column 2, line 3 after flap member change "12" to --21--

Signed and Sealed this

*Twenty-third* Day of *June 1981*

[SEAL]

*Attest:*

RENE D. TEGTMEYER

*Attesting Officer*

*Acting Commissioner of Patents and Trademarks*